US009296552B2

(12) United States Patent
Schleuning et al.

(10) Patent No.: US 9,296,552 B2
(45) Date of Patent: Mar. 29, 2016

(54) SHIRT FRAME ASSEMBLY

(71) Applicant: Shirtframe, LLC, Louisville, KY (US)

(72) Inventors: Todd M Schleuning, Louisville, KY (US); Cheryl Schleuning, Louisville, KY (US)

(73) Assignee: Shirtframe, LLC, Louisville, KY (US)

( * ) Notice: Subject to any disclaimer, the term of this patent is extended or adjusted under 35 U.S.C. 154(b) by 0 days.

(21) Appl. No.: 14/287,683

(22) Filed: May 27, 2014

(65) Prior Publication Data

US 2014/0353341 A1 Dec. 4, 2014

Related U.S. Application Data

(60) Provisional application No. 61/827,849, filed on May 28, 2013.

(51) Int. Cl.
*B65D 85/18* (2006.01)
*D06C 3/08* (2006.01)

(52) U.S. Cl.
CPC ..... *B65D 85/182* (2013.01); *D06C 3/08* (2013.01)

(58) Field of Classification Search
CPC ..... D06F 59/00; D06F 59/02; D06C 3/08; B44D 3/185; A47G 1/12; A45C 13/03; A45C 13/04; B65D 85/18; B65D 85/182
USPC ..... 38/102, 102.1, 102.2, 102.91; 40/700; 223/52
See application file for complete search history.

(56) References Cited

U.S. PATENT DOCUMENTS

| | | | | | |
|---|---|---|---|---|---|
| 2,180,059 | A * | 11/1939 | Kandle | 38/102.2 | |
| 2,760,299 | A * | 8/1956 | Gable et al. | 38/102.2 | |
| 3,559,316 | A * | 2/1971 | Galper | 38/102.91 | |
| 3,885,333 | A * | 5/1975 | Zachary | 38/102.2 | |
| 3,946,863 | A | 3/1976 | Glasband et al. | | |
| 4,030,220 | A * | 6/1977 | Kotchen | 40/700 | |
| 4,071,139 | A * | 1/1978 | Pernicano | B65D 77/24 | 206/216 |
| 4,277,901 | A * | 7/1981 | Williams | 38/102.2 | |
| 4,756,108 | A | 7/1988 | Lackey et al. | | |
| 5,222,314 | A * | 6/1993 | Inteso | 38/102.2 | |
| 5,557,870 | A | 9/1996 | Bergman | | |
| 5,718,331 | A * | 2/1998 | Smith | 206/292 | |
| 6,012,573 | A | 1/2000 | Kurimoto | | |
| 6,158,828 | A | 12/2000 | Vacovsky et al. | | |
| 7,591,097 | B2 * | 9/2009 | Alman et al. | 40/800 | |
| 8,950,096 | B2 * | 2/2015 | Justin, III | 40/800 | |
| 2007/0137081 | A1 * | 6/2007 | Chang | 40/781 | |
| 2012/0260551 | A1 * | 10/2012 | Andrulewich | 40/777 | |

* cited by examiner

*Primary Examiner* — Ismael Izaguirre
(74) *Attorney, Agent, or Firm* — Frost Brown Todd LLC

(57) ABSTRACT

A frame assembly for displaying a shirt includes a blocking member, a frame, and a backing member. The blocking member can receive a shirt such that the shirt is positioned on the front surface of the blocking member and folded about the blocking member to position a neckline of the shirt onto the rear surface of the blocking member. The blocking member is inserted within the frame to display the shirt through the front surface of the frame. The backing member is coupled with the rear surface of the frame to releasably secure the blocking member within the frame.

19 Claims, 9 Drawing Sheets

SHIRT FRAME ASSEMBLY

PRIORITY

This application claims priority to U.S. Provisional Patent Application Ser. No. 61/827,849, entitled "Means and Methods of Framing Shirts," filed on May 28, 2013, the disclosure of which is incorporated by reference herein.

BACKGROUND

In some instances, it is desirable to display a shirt for decorative purposes. For example, a shirt can include a design or a logo representing various occurrences, various geographical areas, various associations, etc. Accordingly, described herein are versions of a shirt frame assembly that can be used to display such designs or logos of a shirt. The shirt frame assembly can further be used to protect the shirt from damage and/or deterioration.

While a variety of shirt frames have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain embodiments taken in conjunction with the accompanying drawings, in which like reference numerals identify the same elements.

Figure 1:
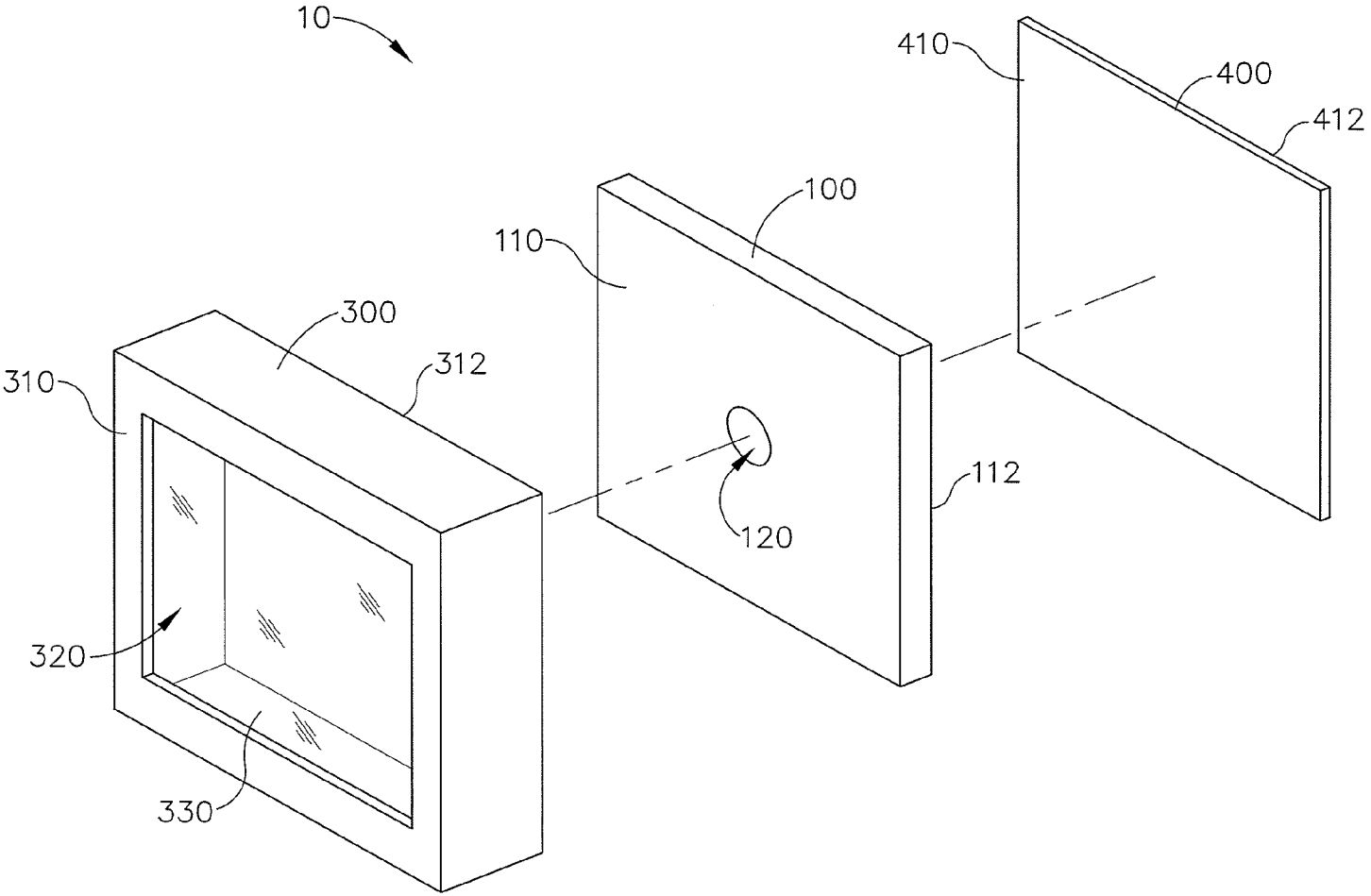
FIG. 1 depicts a perspective exploded view of a shirt frame assembly.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain embodiments of the present disclosure should not be used to limit the scope of the present disclosure. Other examples, features, aspects, embodiments, and advantages of the invention will become apparent to those skilled in the art from the following description, which is by way of illustration, one of the best modes contemplated for carrying out the invention. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

I. Components of a Shirt Frame Assembly

FIG. 1 shows shirt frame assembly (10) comprising a frame (300), a blocking member (100), and a backing member (400). Frame (300) is configured to releasably receive blocking member (100) and backing member (400). Frame (300) comprises a front surface (310), a rear surface (312), and an opening (320) extending through front surface (310) and rear surface (312). Frame is configured for displaying a shirt (200) through opening (320) of front surface (310). Frame (300) can be made of wood, plastic, or other suitable rigid material. In the present embodiment, frame (300) comprises a sheet of glass (330) positioned within opening (320). Glass (330) can be positioned within frame (300) toward front surface (310) such that shirt (200) is positioned within frame (300) behind glass (330). Glass (330) may prevent damage and/or deterioration to shirt (200). Glass (330) can include other suitable transparent materials, such as plastic. It should be noted that glass (330) is merely optional.

Blocking member (100) comprises a front surface (110) and a rear surface (112). Accordingly, shirt (200) can be positioned with a logo (220) on front surface (110) of blocking member (100). Shirt (200) can then be wrapped around to rear surface (112) of blocking member (100), which will be described in more detail below. Blocking member (100) can then be inserted within frame (300) with front surface (110) of blocking member (100) facing towards front surface (310) of frame (300). For instance, front surface (310) of blocking member (100) can hold logo (220) of shirt (200) against glass (330) of frame (300). In the present embodiment, blocking member (100) comprises closed-cell, non-crosslinked polyethylene foam. Polyethylene can be non-dusting, non-toxic, odorless and/or resist mildew. Blocking member (100) can comprise other suitable materials, such as other foams or cardboard, that has sufficient rigidity to receive a shirt (200). In some versions, blocking member (100) can be slightly compressible such that blocking member (100) compresses within frame (300) to hold shirt (200) against frame (300).

FIG. 1 shows blocking member (100) comprising an opening (120) in the central portion of blocking member (100). In some versions, opening (120) is offset on blocking member (100). Opening (120) can be used to grasp blocking member (100) during assembly of shirt frame assembly (10), but opening (120) is merely optional. Backing member (400) comprises a front surface (410) and a rear surface (412). Backing member (400) is releasably secured with rear surface (312) frame (300) to maintain blocking member (100) within frame (300). For instance, front surface (410) of backing member (400) can engage rear surface (312) of frame (300) to couple backing member (400) with frame (300), or rear surface (412) of backing member (400) can be generally aligned with rear surface (312) of frame (300) to couple backing member (400) with frame (300). Backing member (400) can be made from cardboard, wood, or other suitable material with sufficient rigidity to hold blocking member (100) within frame (300).

FIG. 1 shows shirt frame assembly (10) having a rectangular shape. Accordingly, frame (300) can be oriented in a landscape orientation with the length extending substantially horizontally, a portrait orientation with the length extending generally vertically, or any other suitable orientation. Opening (320) of frame (300) is sized to display a logo (220) on a shirt (200). For instance, opening (320) can have a length of about 14 inches and a width of about 11 inches. In other versions, opening (320) can have a length of about 13 inches and a width of about 10 inches. Other suitable dimensions for opening (320) and/or frame (300) will be apparent to one with ordinary skill in the art in view of the teachings herein. Opening (320) and/or frame (300) can also have other suitable shapes, such as square, triangular, hexagonal, octagonal, circular, etc.

Blocking member (100) is sized to correspond with frame (300) such that blocking member (100) is insertable within opening (320) of frame (300). In the present embodiment, blocking member (100) is slightly smaller than frame (300) to accommodate the thickness of a shirt (200) between blocking member (100) and frame (300). For instance, blocking member (100) can be sized to allow about a ⅛ inch gap between blocking member (100) and frame (300) on each side of blocking member (100). Blocking member (100) may thereby hold shirt (200) taut against frame (300) to prevent shirt (200) from wrinkling. Backing component (400) is also sized to correspond with frame (300). Backing component (400) is positioned to extend outwardly past opening (320) of frame (300) to the walls of rear surface (312) of frame (300). Blocking member (100) and backing member (400) are shown in FIG. 1 as rectangular. Alternatively, blocking member (100) and/or backing member (400) can also have other suitable shapes, such as square, triangular, hexagonal, octagonal, circular, etc.

Frame (300) has a sufficient depth to receive blocking member (100), a shirt (200), and backing member (400). Accordingly, blocking member (100) is inserted toward front surface (310) of frame (300) to allow a gap between rear surface (112) of blocking member (100) and rear surface (312) of frame (300) to allow the excess material of shirt (200) to be folded onto rear surface (112) of blocking member (100) within frame (300). For instance, frame (300) can have a depth of about 2 inches and blocking member (100) can have a depth of about 1 inch. Other suitable dimensions for blocking member (100) and/or frame (300) will be apparent to one with ordinary skill in the art in view of the teachings herein. In the present embodiment, backing member (400) is inserted within frame (300) to maintain blocking member (100) within frame (300) such that rear surface (412) of backing member (400) is substantially flush with rear surface (312) of frame (300). Alternatively, backing member (400) can further inwardly and/or outwardly from frame (300). Backing member (400) can have a depth of about ⅛ inches, but other suitable dimensions can be used.

Figure 2:
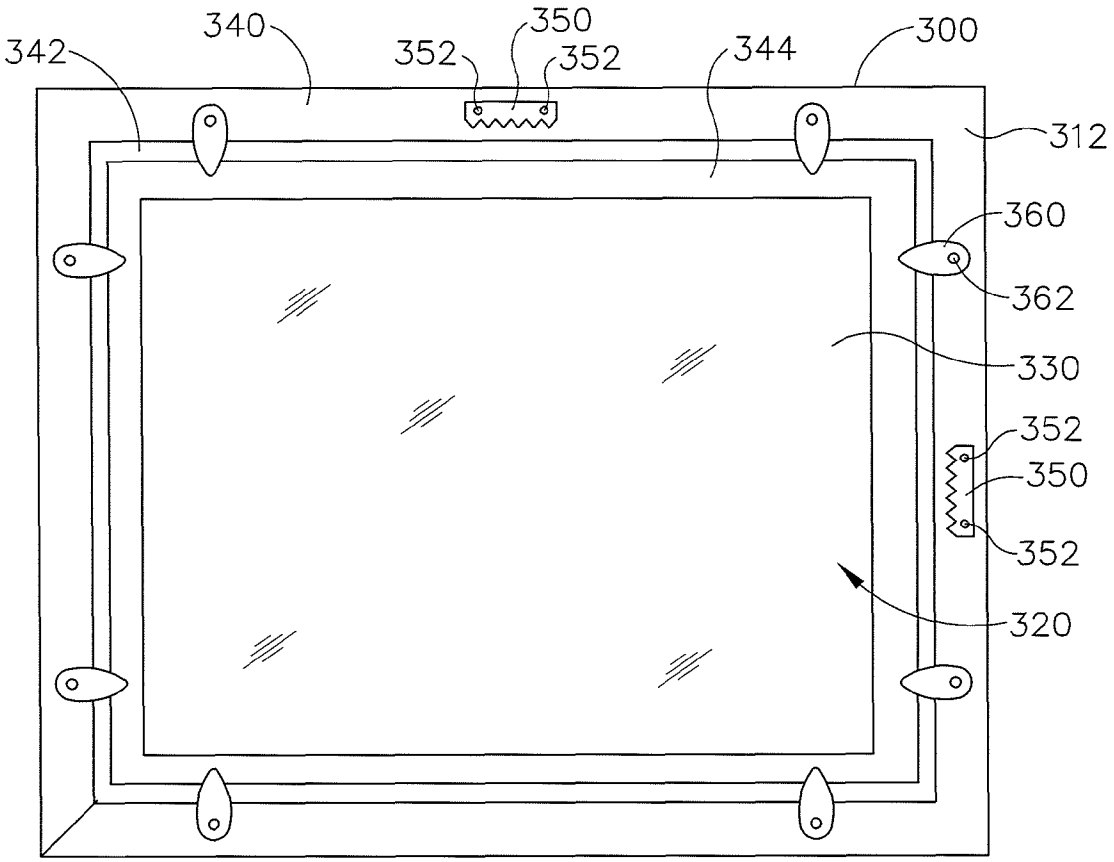
FIG. 2 depicts a back view of a frame of the shirt frame assembly of FIG. 1.

As best seen in FIG. 2, frame (300) includes an outer wall (340), a central wall (342), and an inner wall (344). Central wall (342) extends inwardly from outer wall (340). Inner wall (344) then extends inwardly from central wall (342). Accordingly, opening (320) narrows from outer wall (340) to inner wall (344). In the present embodiment, inner wall (344) comprises glass (330) positioned within inner wall (344). Inner wall (344) is configured to receive blocking member (100). Blocking member (100) is inserted within frame (300) such that front surface (110) of blocking member (100) positions shirt (200) against inner wall (344) of frame (300). Inner wall (344) may thereby prevent shirt (200) from wrinkling. In some versions, inner wall (344) is omitted such that blocking member (100) positions shirt (200) against glass (330). In other versions, frame (300) is transparent such that opening (320) of frame (300) is omitted and shirt (200) is displayed through front surface (310) of the transparent frame (300). Central wall (342) is configured to receive backing member (400). Accordingly, front surface (410) of backing member (400) engages central wall (342) to align rear surface (412) of backing member (400) with rear surface (312) of frame (300). Of course, central wall (342) can be omitted such that backing member (400) engages rear surface (312) of frame. Other suitable configurations for frame (300) will be apparent to one with ordinary skill in the art in view of the teachings herein.

Outer wall (340) comprises a plurality of fasteners (360) to releasably secure backing member (400) with frame (300). Fasteners (360) of the present embodiment extend inwardly from frame (300) and are coupled with frame (300) via pins (362) that allow fasteners (360) to rotate relative to frame (300). Fasteners (360) can be rotated out of opening (320) (not shown) to allow backing member (400) to be inserted within frame (300). Fasteners (360) then rotate to extend inwardly onto backing member (400) to secure backing member (400) with frame (300). Other suitable configurations for fasteners (360) will be apparent to one with ordinary skill in the art in view of the teachings herein.

Outer wall (340) further comprises at least one hanger (350) coupled with outer wall (340). Hanger (350) can be coupled with outer wall (340) by screws (352) or other suitable fastener. Hanger (350) can be used to hang frame (300) on a wall or other surface. FIG. 2 shows a first hanger (350) positioned on a first side of outer wall (340) and a second hanger (350) positioned on a second side of outer wall (340) adjacent to the first side of outer wall (340). This accommodates various orientations of logos on shirt (200) and allows frame (300) to be hung to display shirt (200) in either a landscape orientation or a portrait orientation. Other suitable configurations for hangers (350) will be apparent to one with ordinary skill in the art in view of the teachings herein. In some versions, hangers (350) are omitted such that frame (300) can be set on a desk, table, or other surface to display shirt (200).

II. Method for Framing a Shirt

Figure 3:
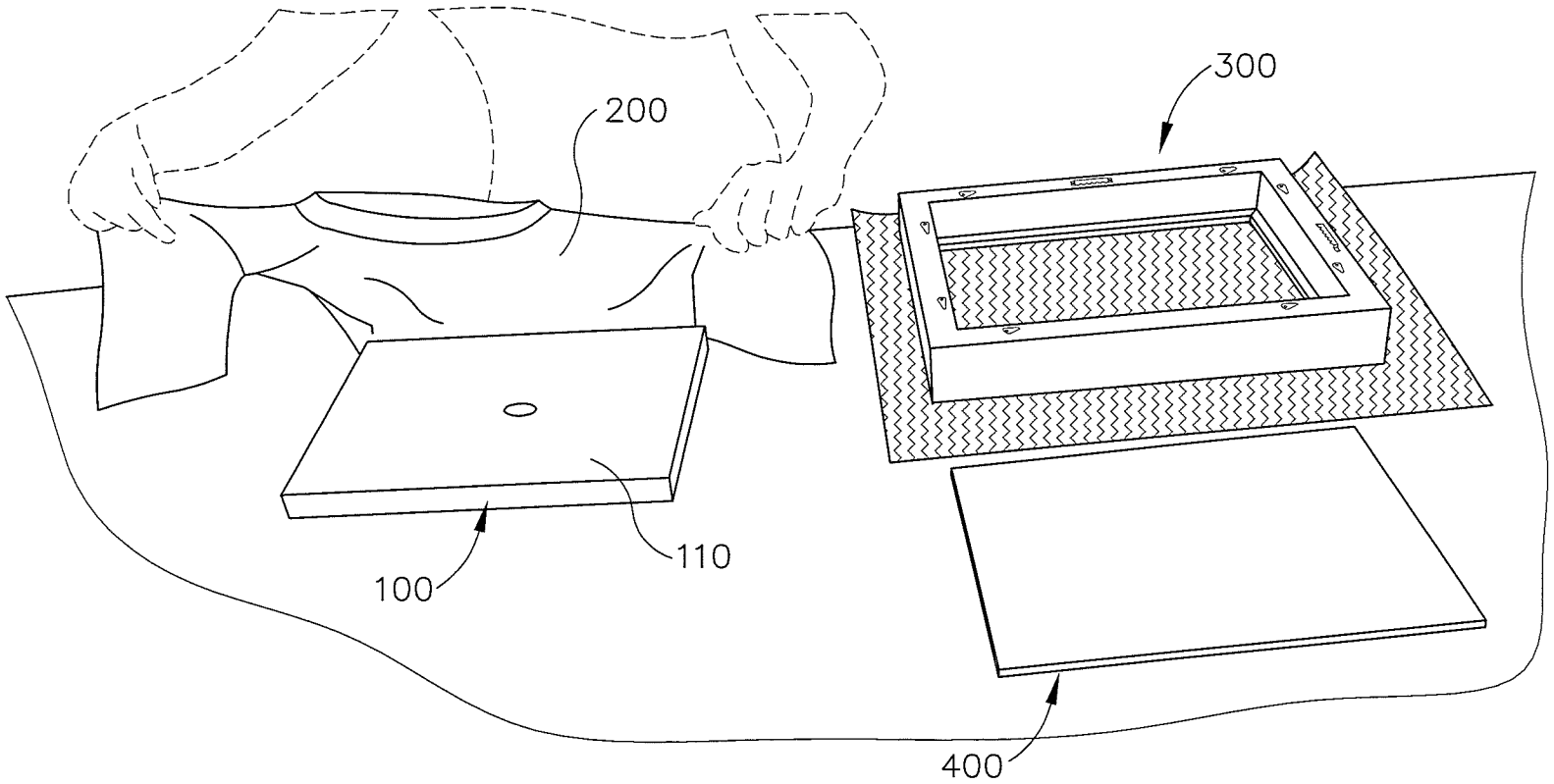
FIG. 3 depicts a perspective view of a shirt being positioned onto a blocking member of the shirt frame assembly of FIG. 1.
Figure 4:
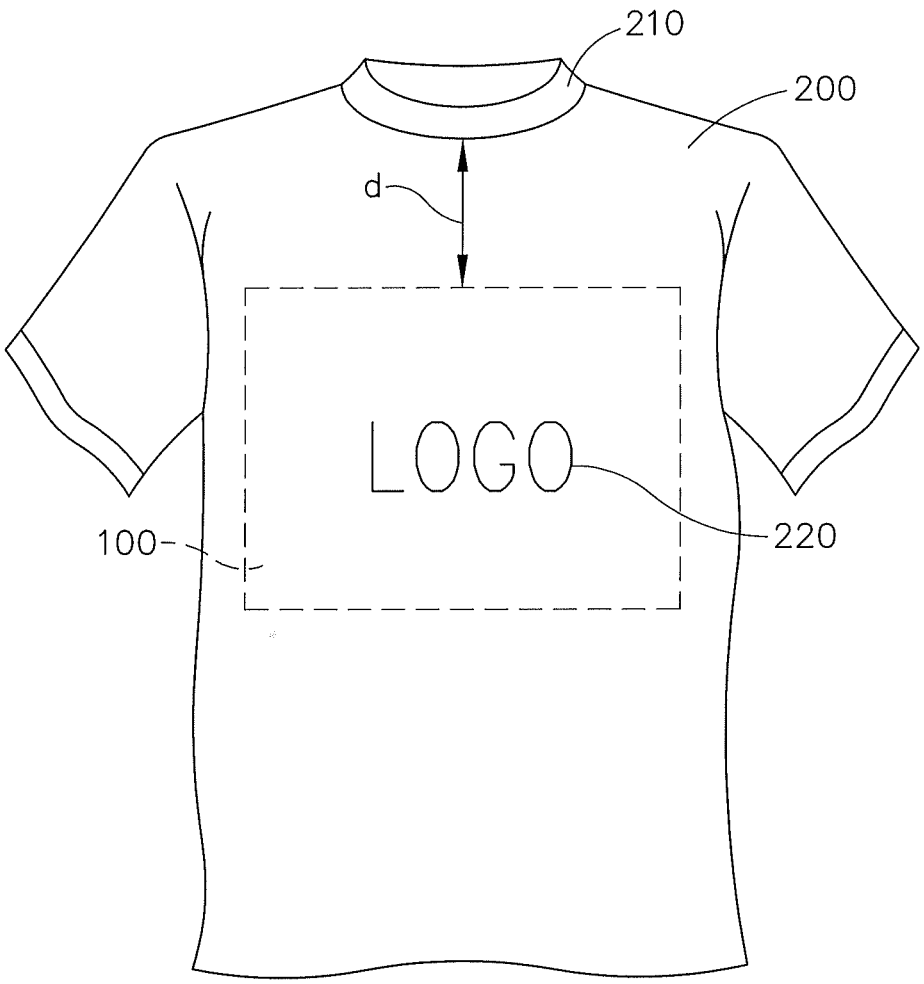
FIG. 4 depicts a front view of the shirt positioned on the blocking member of FIG. 3.

FIGS. 3-9 show a method for framing shirt (200) with shirt frame assembly (10). In FIG. 3, shirt (200) is being positioned onto front surface (110) of blocking member (100). This allows logo (220) of shirt (200) to face outwardly from front surface (110) of blocking member (100). Shirt (200) can be stretched over blocking member (100) to remove wrinkles from shirt (200). FIG. 4 shows shirt (200) positioned on blocking member (100). As shown, a top edge of blocking member (100) is positioned a distance d below neckline (210) of shirt (200). This can position logo (220) of shirt (200) centrally on blocking member (100). Distance d can be about 3 inches, but other suitable distances will be apparent to one with ordinary skill in the art in view of the teachings herein. Logo (220) can also be offset on blocking member (100). While FIG. 4 shows blocking member (100) positioned in a portrait orientation, blocking member (100) can be positioned in any other suitable orientation, such as landscape.

Figure 5:
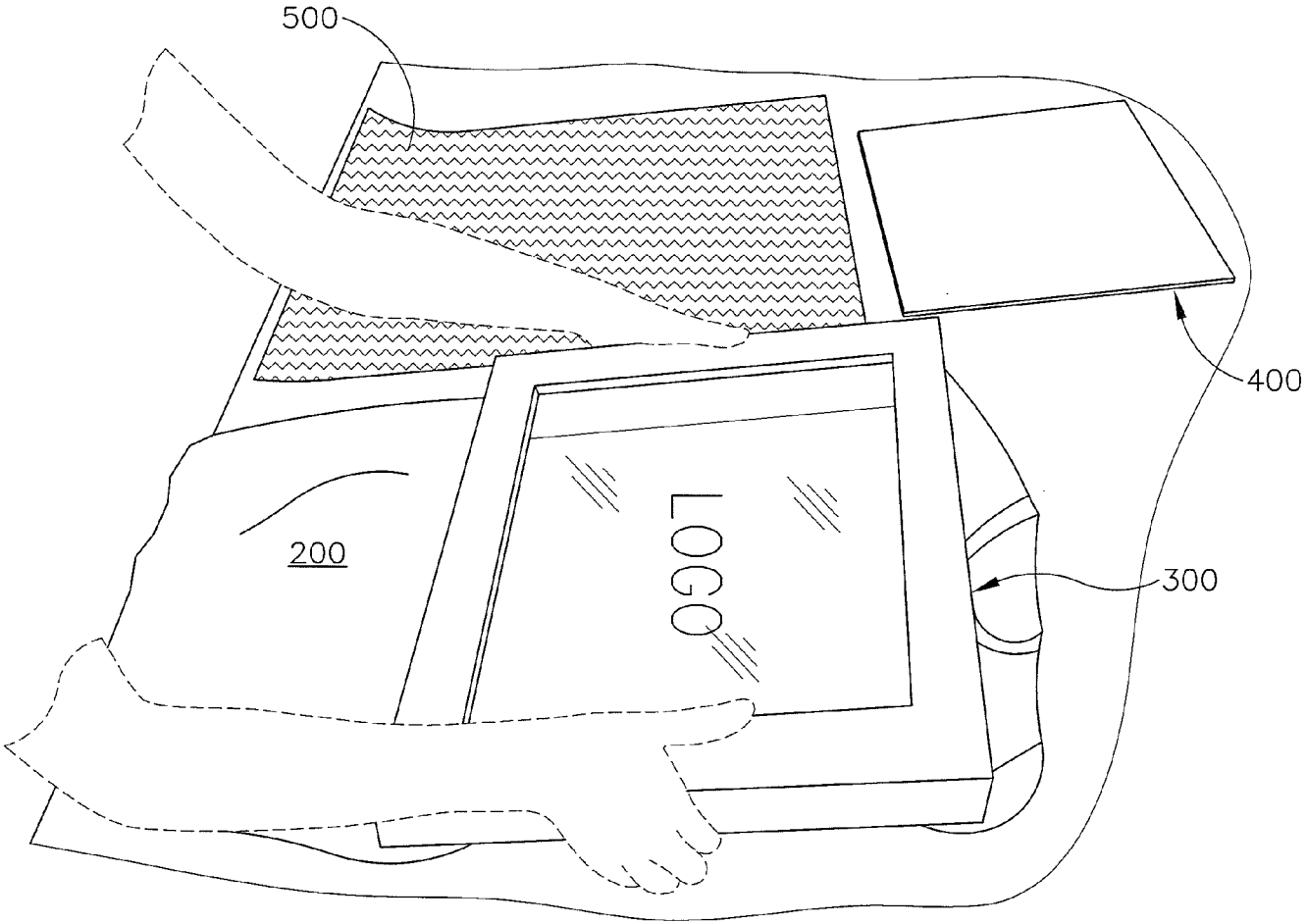
FIG. 5 depicts a perspective view of the frame of being positioned onto the blocking member of FIG. 3.

Blocking member (100) and shirt (200) are then inserted within frame (300). As shown in FIG. 5, frame (300) can be placed on blocking member (100) and shirt (200) to insert blocking member (100) and shirt (200) within frame (300). This positions logo (220) of shirt (200) within opening (320) of frame (300). As blocking member (100) and shirt (200) are inserted within frame (300), front surface (110) of blocking member (100) pushes shirt (200) against inner wall (344) and/or glass (330) of frame (300). The sides of blocking member (100) can further push shirt (200) against the sides of frame (300). This can prevent shirt (200) from wrinkling within frame (300).

Figure 6:
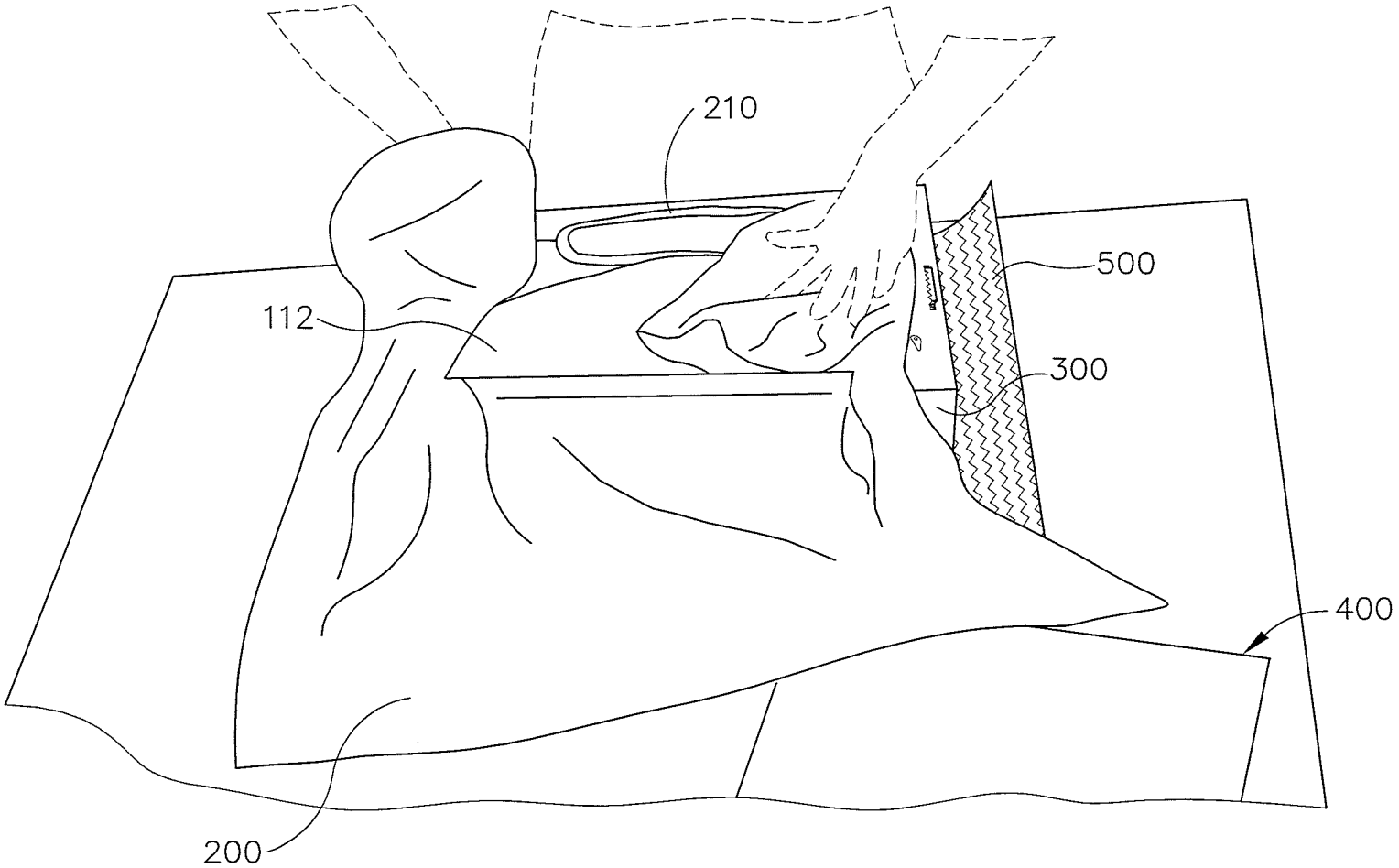
FIG. 6 depicts a perspective view of the shirt being wrapped around the blocking member of FIG. 3.
Figure 7:
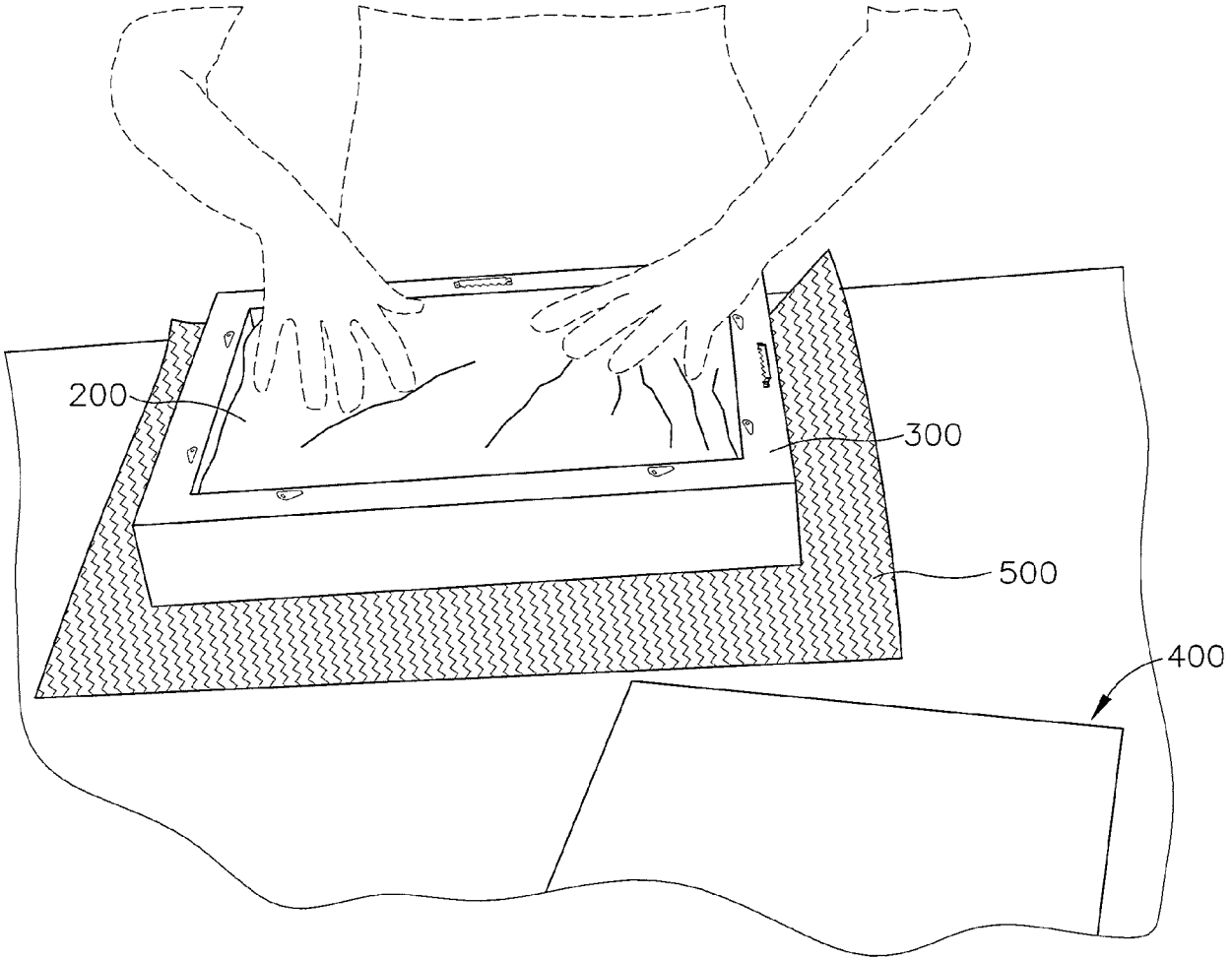
FIG. 7 depicts a perspective view of the shirt wrapped around the blocking member of FIG. 3.

The excess material of shirt (200) is then folded onto rear surface (112) of blocking member (100) within frame (300), as shown in FIG. 6. Shirt (200) is wrapped around blocking member (100) such that neckline (210) is folded onto rear surface (112) of blocking member (100). Shirt (200) is then folded to wrap around each side of blocking member (100) to cover rear surface (112) of blocking member (100) to encompass blocking member (100) within shirt (200), as shown in FIG. 7. Shirt (200) and blocking member (100) are thereby inserted within frame (300) such that shirt (200) and blocking member (100) are positioned between front surface (310) and rear surface (312) of frame (300). As shown in FIGS. 6-7, frame (300), shirt (200), and blocking member (100) can be flipped such that frame (300) is facing downwardly to fold shirt (200) onto rear surface (112) of blocking member (100). When frame (300) is flipped, frame (300) can be positioned on a protective layer (500). Protective layer (500) can be any suitable material, such as cloth or bubble wrap, to prevent damage to frame (300) during assembly.

Figure 8:
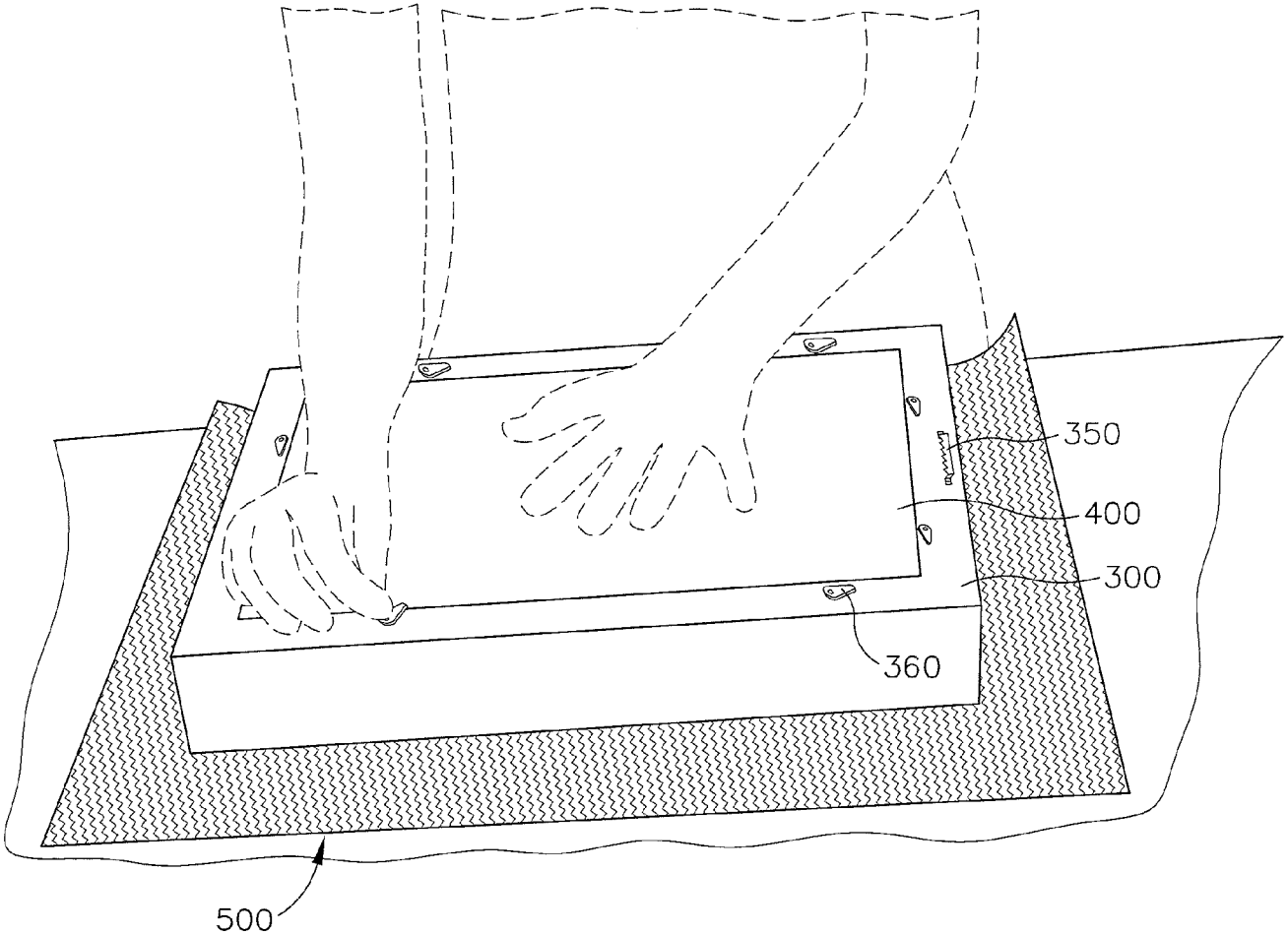
FIG. 8 depicts a perspective view of a backing member being coupled with the frame of FIG. 2.
Figure 9:
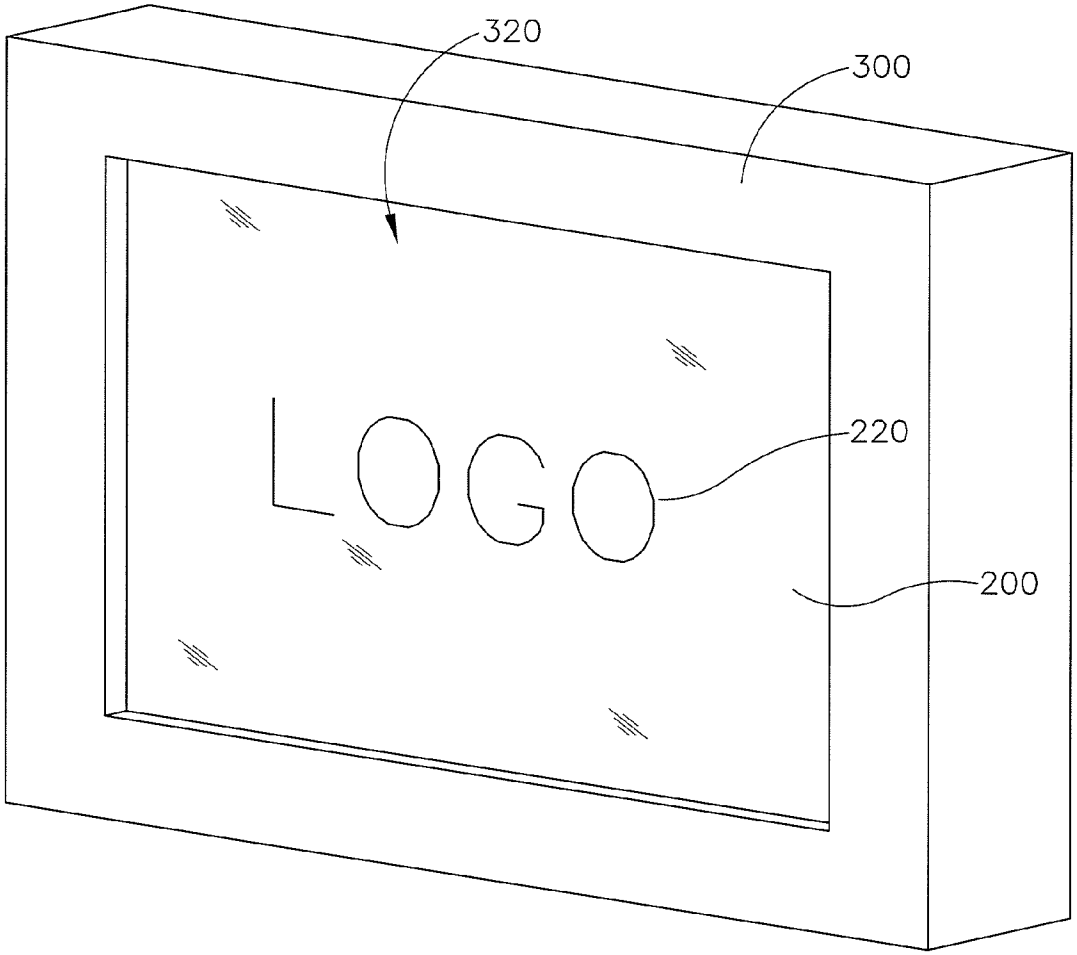
FIG. 9 depicts a front view of the shirt frame assembly of FIG. 1 displaying the shirt.

Backing member (400) is then coupled with frame (300) to maintain blocking member (100) and shirt (200) within frame (300), as shown in FIG. 8. In the present embodiment, backing member (400) is inserted within frame (300) to contact central wall (342) of frame (300) to align rear surface (412) of backing member (400) with rear surface (312) of frame (300). Fasteners (360) are then rotated to extend onto rear surface (412) of backing member (400) to secure backing member (400) within frame (300). Shirt frame assembly (10) is thereby assembled to display logo (220) of shirt (200) through opening (320) of frame (300), as shown in FIG. 9. Shirt frame assembly (10) can thereby be used to frame shirt (200) in about 30 seconds or less. Frame (300) can then be hung on a wall with hangers (350).

Although the present disclosure describes shirt frame assembly (10) as displaying a logo (220) positioned centrally on a shirt (200), shirt frame assembly (10) can be used to display any design positioned on any area of any suitable garment. For instance, shirt frame assembly (10) can be used to display a design positioned centrally or offset on a front surface or a rear surface of a garment. Suitable garments can include t-shirts having short sleeves or long sleeves, jerseys, button-down shirts, pants, shorts, etc.

It should be understood that any one or more of the teachings, expressions, embodiments, examples, etc. disclosed herein may be combined with any one or more of the other teachings, expressions, embodiments, examples, etc. that are disclosed herein. The teachings, expressions, embodiments, examples, etc. disclosed herein should therefore not be viewed in isolation relative to each other. Various suitable ways in which numerous aspects of the present disclosure may be combined will be readily apparent to those of ordinary skill in the art in view of the teachings disclosed herein. Such modifications and variations are intended to be included within the scope of both the present disclosure and the claims.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, examples, embodiments, geometrics, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

We claim:

1. A frame assembly for displaying a shirt comprising:

a blocking member comprising a front surface and a rear surface, wherein the blocking member is configured to receive a shirt such that the shirt is positioned on the front surface of the blocking member and folded about the blocking member to position a neckline of the shirt onto the rear surface of the blocking member; and a frame comprising a front surface, wherein the blocking member is insertable within the frame, wherein the frame is configured to display the shirt through the front surface of the frame;

wherein the blocking member is sized to form a gap between the rear surface of the blocking member and a rear surface of the frame such that the shirt is foldable within the gap.

2. The frame assembly of claim 1, wherein the frame comprises an opening extending between the front surface and a rear surface, wherein the frame is configured to display the shirt through the opening.

3. The frame assembly of claim 2, wherein the frame comprises glass positioned within the opening.

4. The frame assembly of claim 1, wherein the rear surface of the blocking member is covered by the shirt.

5. The frame assembly of claim 1, wherein the blocking member comprises an opening configured for grasping.

6. The frame assembly of claim 1, wherein the blocking member is sized to form a gap between each side of the blocking member and each side of the frame.

7. The frame assembly of claim 1, wherein the frame assembly is rectangular.

8. The frame assembly of claim 1, wherein the frame comprises at least one hanger configured for hanging the frame.

9. The frame assembly of claim 1, wherein the frame comprises an outer wall and an inner wall extending inwardly from the outer wall, wherein the inner wall is configured to receive the blocking member.

10. The frame assembly of claim 1 further comprising a protective layer positionable against the front surface of the frame.

11. The frame assembly of claim 1, further comprising a backing member couplable with the rear surface of the frame, wherein the backing member is configured to releasably secure the blocking member within the frame.

12. The frame assembly of claim 11, wherein the frame comprises a plurality of fasteners configured to releasably couple the backing member with the frame.

13. The frame assembly of claim 11, wherein the frame comprises an outer wall and a central wall extending inwardly from the outer wall, wherein the central wall is configured to receive the backing member.

14. A frame assembly for displaying a shirt comprising:

a blocking member comprising a front surface and a rear surface, wherein the front surface of the blocking member is positionable onto a shirt such that the blocking member is positioned at a predetermined distance below a neckline of the shirt; and a frame comprising a front surface and sides extending backward from the front surface, wherein the blocking member is insertable within the frame such that the sides of the frame extend beyond the rear surface of the blocking member, wherein the frame is configured to display the shirt through the front surface of the frame;

wherein the blocking member is sized to form a gap between each side of the blocking member and each side of the frame.

15. A method for displaying a shirt using a frame assembly comprising a blocking member and a frame, the method comprising the steps of:

positioning a shirt on a front surface of the blocking member such that a design of the shirt is aligned with the front surface of the blocking member;

inserting the blocking member into the frame such that the design of the shirt is displayed through a front surface of the frame, wherein the blocking member is sized to form a gap between a rear surface of the blocking member and a rear surface of the frame; and folding the shirt around the blocking member within the gap between the rear surface of the blocking member and the rear surface of the frame such that a neckline of the shirt is positioned on a rear surface of the blocking member and the blocking member is enclosed by the shirt.

16. The method of claim 15, wherein positioning the shirt on the front surface of the blocking member further comprises positioning the blocking member at a pre-determined distance below a neckline of the shirt.

17. The method of claim 15, wherein inserting the blocking member into the frame further comprises positioning the front surface of the blocking member adjacent to an inner wall of the frame to hold the shirt against the inner wall of the frame.

18. The method of claim 15, further comprising coupling a backing member to the rear surface of the frame to secure the shirt and blocking member within the frame.

19. The method of claim 18, wherein coupling the backing member to the rear surface of the frame further comprises positioning the backing member adjacent to a central wall of the frame to align the backing member with the rear surface of the frame.

* * * * *